US005261170A

United States Patent [19]

Ward

[11] Patent Number: 5,261,170

[45] Date of Patent: Nov. 16, 1993

[54] WEAR STRIPS

[75] Inventor: Roger A. Ward, Sheffield, Great Britain

[73] Assignee: Milard (Hard Metals) Limited, Sheffield, United Kingdom

[21] Appl. No.: 848,972

[22] PCT Filed: Jan. 9, 1991

[86] PCT No.: PCT/GB91/00027

§ 371 Date: Apr. 16, 1992

§ 102(e) Date: Apr. 16, 1992

[87] PCT Pub. No.: WO91/15637

PCT Pub. Date: Oct. 17, 1991

[30] Foreign Application Priority Data

Apr. 6, 1990 [GB] United Kingdom ..... 9007831

[51] Int. Cl.[5] ..... E02F 9/28; E02F 3/815

[52] U.S. Cl. ..... 37/451; 172/772.5; 37/460

[58] Field of Search ..... 37/141 R, 141 T, 142 R; 172/772, 772.5

[56] References Cited

U.S. PATENT DOCUMENTS 3,529,677 9/1970 Stephenson ..... 172/767
4,052,802 10/1977 Moen et al. ..... 37/141 R
4,128,132 12/1978 Moen et al. ..... 37/141 R X
4,570,366 2/1986 Yost ..... 37/141 T X
4,753,299 6/1988 Meyers ..... 37/141 R X

FOREIGN PATENT DOCUMENTS 279338 9/1970 European Pat. Off. .
WO89/12146 12/1989 PCT Int'l Appl. .

*Primary Examiner*—Randolph A. Reese
*Assistant Examiner*—Arlen L. Olsen
*Attorney, Agent, or Firm*—Trexler, Bushnell, Giangiorgi & Blasckstone, Ltd.

[57] ABSTRACT

A wear strip (A) for use on material handling equipment, such as chutes, plough blades, scrapers and gates, comprises an elongate body (30) of metal of substantially rectangular cross-section, and wear resistant tiles (31) bonded to the body and extending across one face (32) from at least one edge (33), the tiles being spaced along the body which is provided with slots (34) in alignment with the gaps (36) between the tiles (31), to make it possible to bend the strip (A) to suit the curvature of say a plough blade or a scraper to which the strip can then be "stitch" welded and readily removed (when worn) by a cutting torch or an angle grinder. Other wear strips (B and C) have, respectively, further tiles on an adjacent face, and a cross-section of substantially right-angled triangular form.

14 Claims, 8 Drawing Sheets

WEAR STRIPS

BACKGROUND OF THE INVENTION

This invention relates to wear strips, more particularly for use on material handling equipment, such as chutes, plough blades, scrapers and gates, where abrasion is a severe problem, such as when handling sand, clay, glass, coal, iron ore and other minerals.

It is known to provide wear strips of hard-faced mild steel, but these tend to wear away very rapidly when the hard-facing has worn away.

It is also known (see WO/12146) to provide wear strips of rubber of rectangular or square cross-section with wear resistant tiles bonded thereto and extending across one face from and along at least one edge of each wear strip, the tiles being formed of tungsten carbide or other "hard metal" or ceramic material and being spaced from each other along the wear strip so as to allow some flexing to suit the curvature of say a chute or plough blade. In order to secure these wear strips to material handling equipment it is necessary to provide metal-sleeved holes for bolts or embed the heads of bolts in the rubber, but—in either case—the accuracy of positioning of the wear strips depends upon the accuracy of the positions of corresponding holes in the equipment. Also, the provision of numerous holes is an unpopular time consuming task, and any damage to the bolts in use can make replacement of worn wear strips a time consuming task.

On the other hand, the rubber is relatively easy to cut when a less than standard length of wear strip is required, it is wear resistant in its own right, and it offers a degree of shock resistance.

SUMMARY OF THE INVENTION

The object of the present invention is to overcome the disadvantages of the rubber-based wear strips whilst retaining their major advantages.

According to a first aspect of the present invention, a wear strip comprises an elongate body of metal of substantially rectangular (or square) cross-section, and wear resistant tiles bonded to the metal body and extending across one face from at least one edge of the metal body, the tiles being spaced from each other along the metal body, and the metal body being provided with slots extending a major distance through the metal body from the opposite face to the one carrying the tiles, with the slots in alignment with the gaps between the tiles.

The metal is preferably mild steel, thus enabling the body to be "stitch" welded to material handling equipment formed of steel (but other metal may be used for the body and may be welded or brazed to equipment of similar metal) and worn wear strips can be removed readily by means of a cutting torch or an angle grinder.

The slots in the body aligned with the gaps between the tiles make it possible to bend the strip to suit the curvature of say a scraper or a plough blade, and also make it relatively easy to cut the wear strip into smaller lengths The slots are preferably wider than the gaps, so as to afford clearance over a saw blade of a thickness to pass through the gaps.

The tiles are preferably located in a rebate, leaving the other edge of that face of the metal body available for welding (or brazing) and the end tiles are preferably also set slightly short of the ends of the body. Chamfers are preferably provided along two adjacent edges of the body for ease of welding (or brazing).

According to a second aspect of the present invention, a wear strip as in the first aspect also has further wear resistant tiles extending across the adjacent face of the metal body from the same edge as the first-mentioned wear resistant tiles, with the further tiles having gaps between them aligned with the gaps between the first-mentioned tiles, for use of the wear strip for protecting a leading edge of equipment, such as a pan mixer blade. The overlapping of the edges of the slots by the further tiles minimises wear in these regions.

According to a third aspect of the present invention, a wear strip as in the first or second aspect has a metal body with a cross-section of substantially right-angled triangular form, enabling the wear strip to be used along the edge of a scraper which works at an angle to the floor and/or the wall of a mixer.

A wear strip according to any of the three aspects described above may be pre-curved to suit a sharp radius, convexly curved edge of an item of equipment, and the arcuate metal body for such a pre-curved wear strip may be one quarter of a metal ring of appropriate cross-section.

A square corner may be provided by a corner block in which an L-shaped metal body has bonded to it wear resistant tiles, which may be provided on only a front L-shaped face or on both that face and the outer faces of the L-shaped body.

BRIEF DESCRIPTION OF THE DRAWINGS

Embodiments of wear strips in accordance with the invention, and plough blades with such wear strips welded thereto, and also methods of applying such wear strips to plough blades or the like, will now be described, by way of example only, with reference to the accompanying drawings, in which.

DETAILED DESCRIPTION OF THE ILLUSTRATED EMBODIMENTS

Figure 1:
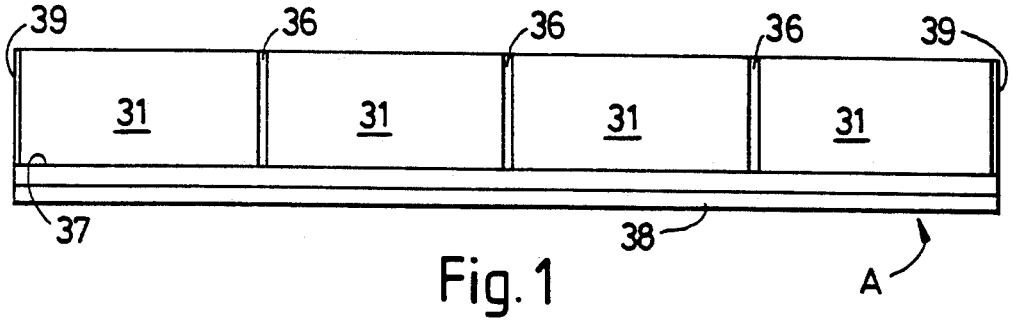
FIG. 1 is the front elevation of a wear strip A in accordance with the first aspect of the invention.
Figure 2:
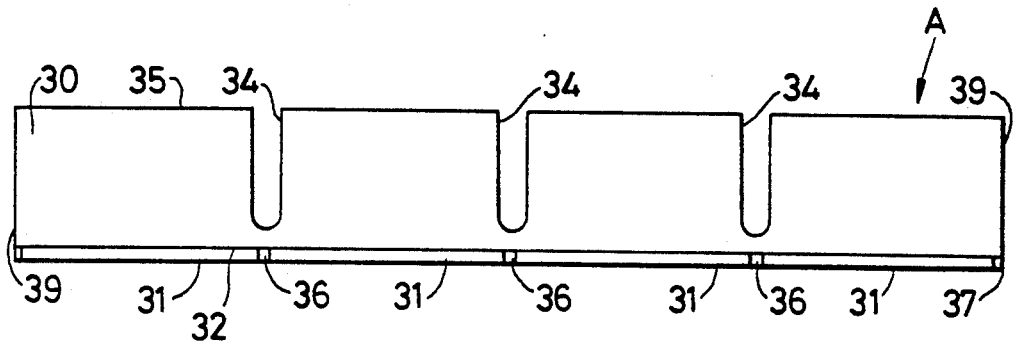
FIG. 2 is the plan of the wear strip of FIG. 1.
Figure 3:
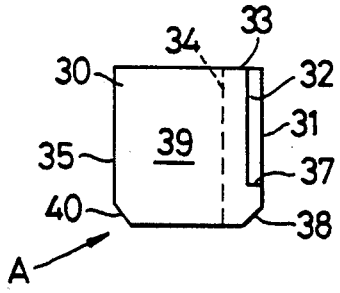
FIG. 3 is an end elevation of the wear strip of FIGS. 1 and 2 as seen from the left hand end of FIG. 1.

The wear strip A shown in FIGS. 1 to 3 comprises an rectangular cross-section, and wear resistant tiles 31 (e.g., of tungsten carbide) bonded to the metal body and extending across one face 32 from one edge 33 of the metal body, the tiles being spaced from each other along the metal body, and the metal body being provided with slots 34 extending a major distance through the metal body from the opposite face 35 to the face 32 carrying the tiles 31, with the slots in alignment with the gaps 36 between the tiles.

The slots 34 in the body 30 aligned with the gaps 36 between the tiles 31 make it possible to bend the strip to suit the curvature of a chute or a plough blade on the lower edge of a pan mixer blade (see FIG. 10), and also make it relatively easy to cut the wear strip into smaller lengths, the slots 34 being wider than the gaps 36, so as to afford clearance over a saw blade of a thickness to pass through the gaps.

The tiles 31 are located in a rebate 37, leaving the other edge 38 of the face 32 available for welding (or brazing) and the end tiles are also set slightly short of the ends 39 of the body. Chamfers are provided along the edge 38 and the adjacent edge 40 of the body for ease of welding (or brazing).

Figure 4:
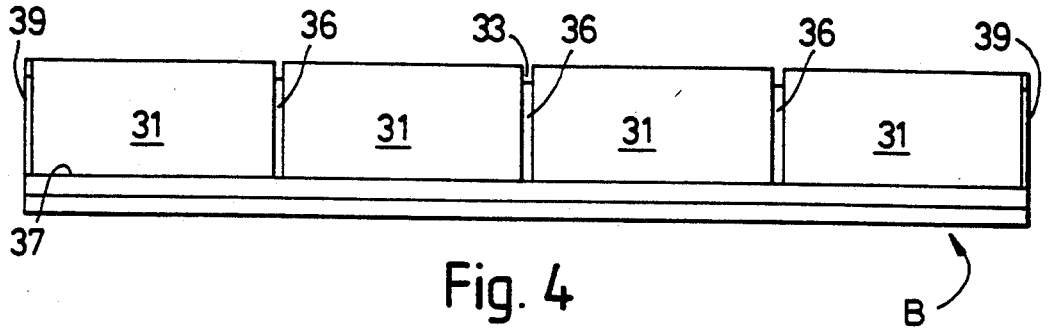
FIGS. 4 to 6 correspond to FIGS. 1 to 3 but show a wear strip B in accordance with the second aspect of the invention.
Figure 5:
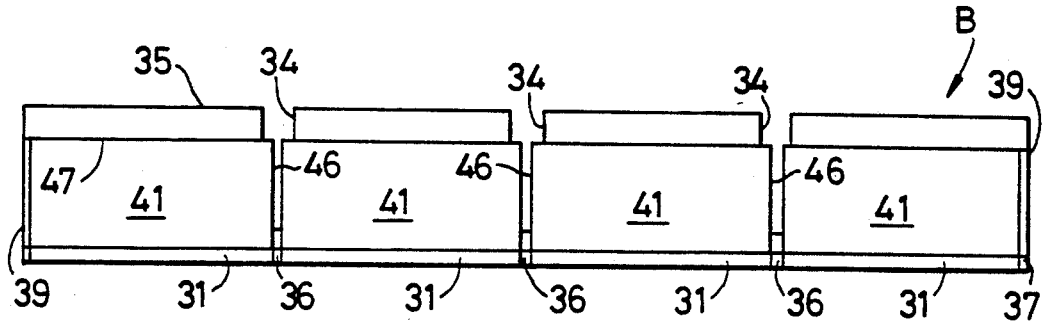
Figure 6:
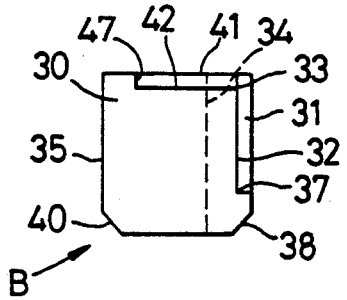
Figure 10:
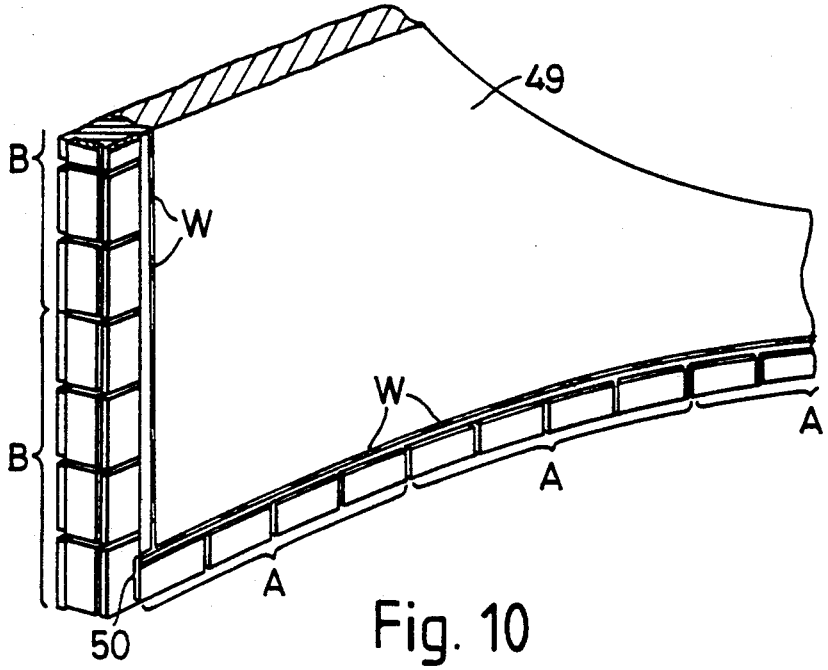
FIG. 10 is a fragmentary perspective view of one end of a pan mixer blade for material handling equipment provided with wear strips A and B.

The wear strip B shown in FIGS. 4 to 6 is the same as the wear strip A of FIGS. 1 to 3 except for further wear resistant tiles 41 across the adjacent face 42 of the metal body 30 from the same edge 33 as the wear resistant tiles 31, with the tiles 41 having gaps 46 between them aligned with the gaps 36 between the tiles 31, for use of the wear strip B for protecting a leading edge of equipment, such as a pan mixer blade (see also FIG. 10). The overlapping of the edges of the slots 46 by the tiles 41 minimizes wear in these regions. The tiles 41 are located in a rebate 47 behind the tiles 31.

Figure 7:
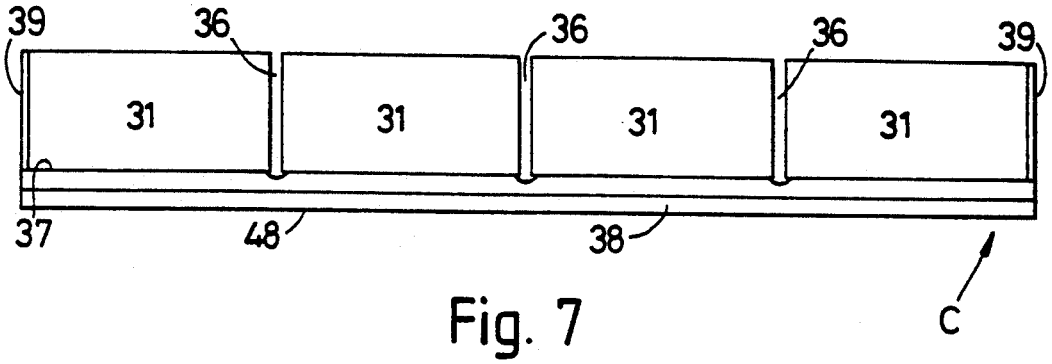
FIGS. 7 to 9 correspond to FIGS. 1 to 3 or FIGS. 4 to 6 but show a wear strip C in accordance with the third aspect of the invention.
Figure 8:
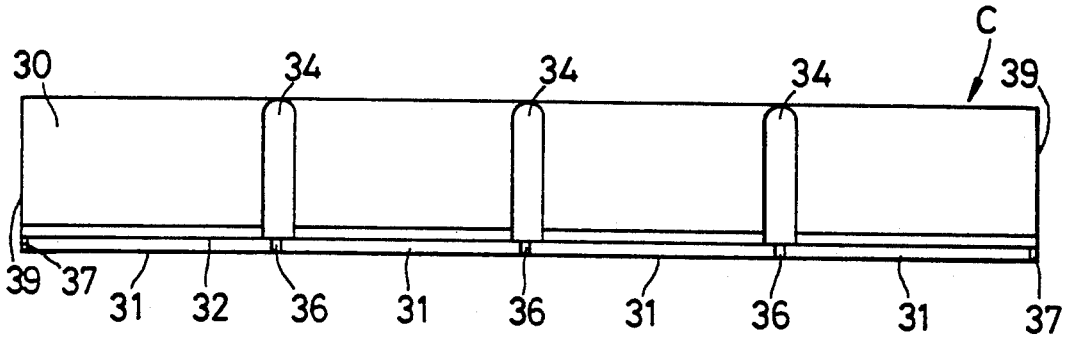
Figure 9:
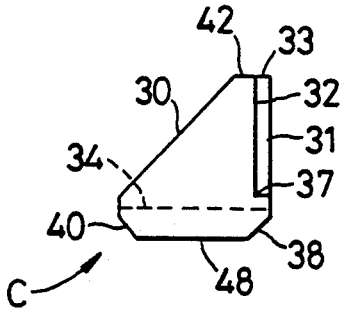
Figure 16:
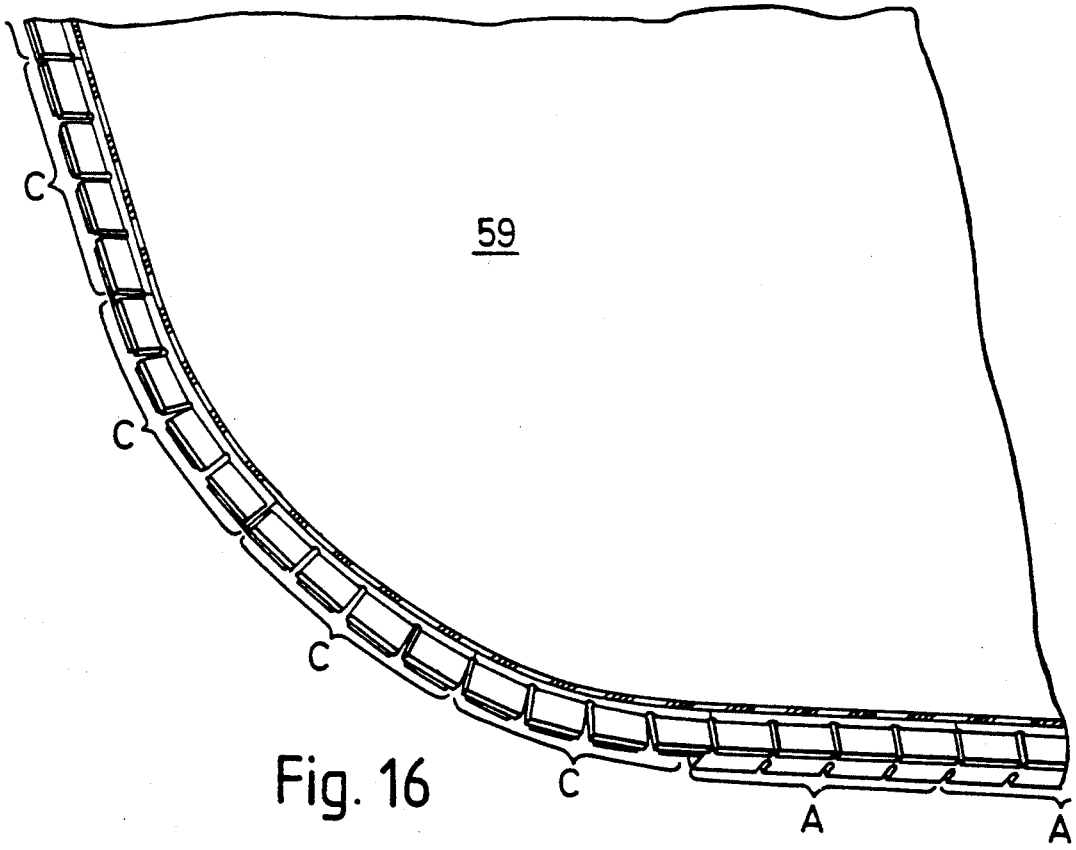
FIG. 16 is a fragmentary perspective view of a scraper for material handling equipment provided with wear strips A and C.
Figure 12:
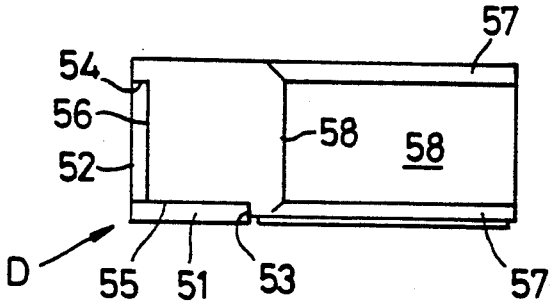
FIG. 12 is the plan of the wear block of FIG. 11.
Figure 13:
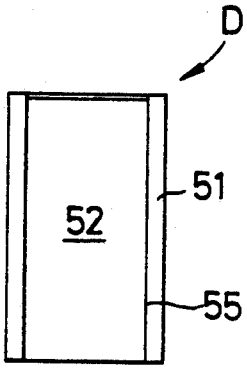
FIG. 13 is the left hand elevation of the wear block.
Figure 11:
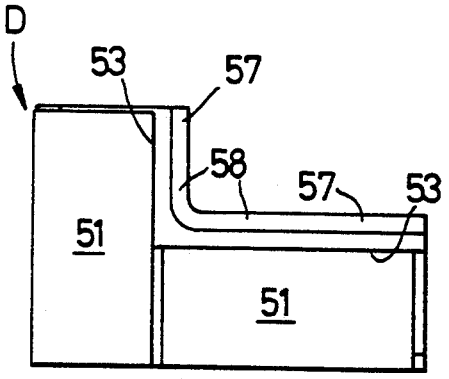
FIG. 11 is the front elevation of a wear block D for simplification of the construction of a corner between wear strips A and B as in FIG. 10.
Figure 14:
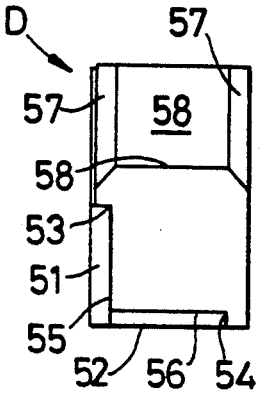
FIG. 14 is the right hand elevation of the wear block.
Figure 15:
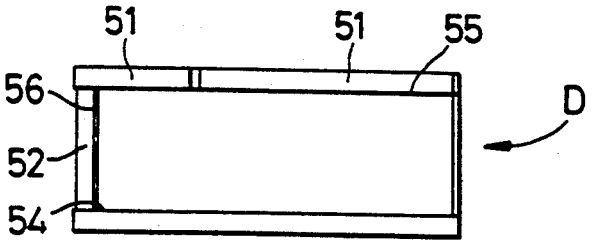
FIG. 15 is the underneath plan of the wear block.
Figure 17:
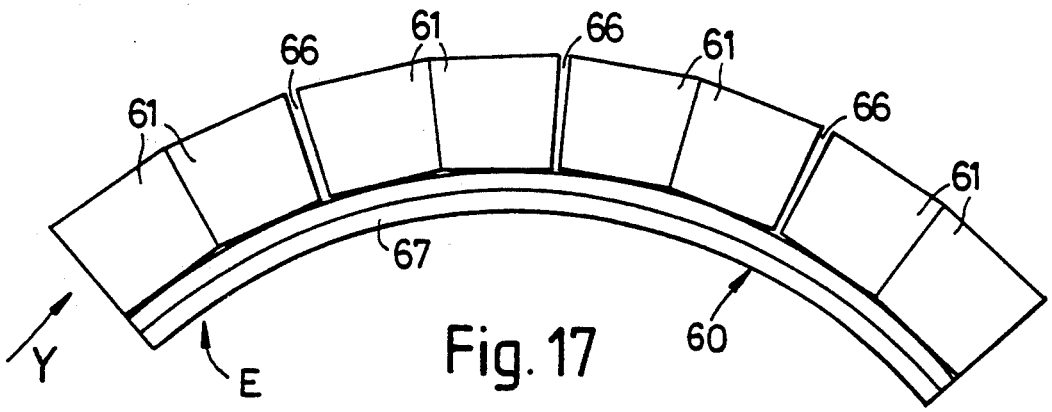
FIG. 17 is the front elevation of a pre-curved wear strip E in accordance with the invention for use on a sharp radius convexly curved edge.
Figure 18:
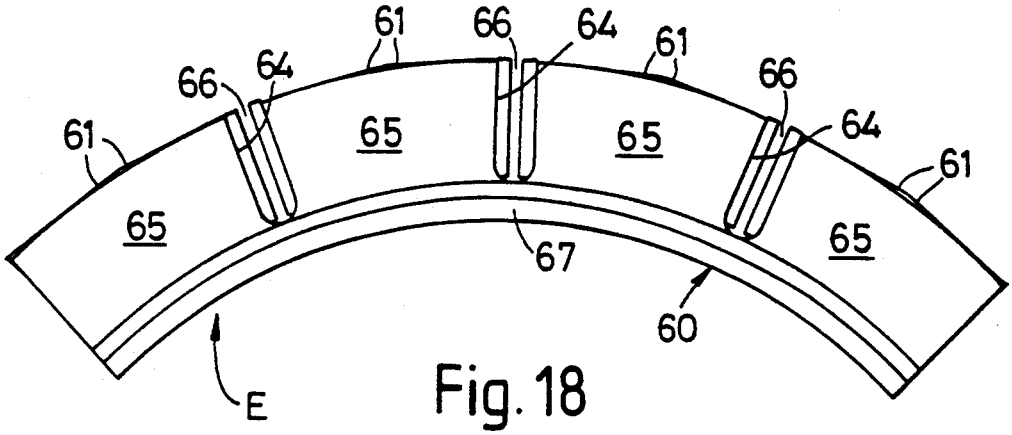
FIG. 18 is the rear elevation of the wear strip E.
Figure 19:
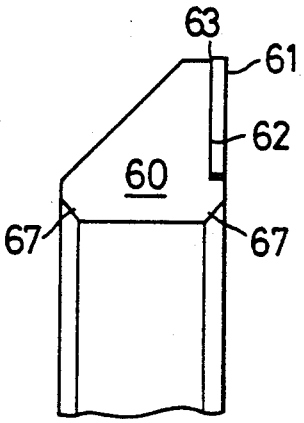
FIG. 19 is a partial end elevation of the wear strip E as seen in the direction of the arrow X in FIG. 17.
Figure 20:
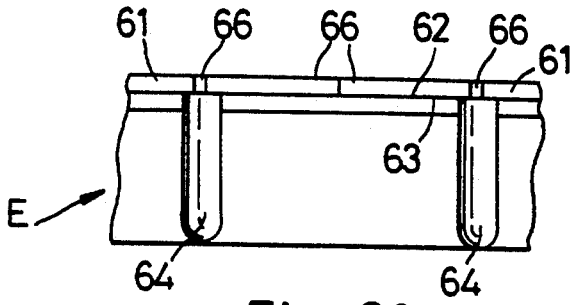
FIG. 20 is a partial plan of the wear strip E as seen in the direction of the arrow y in FIG. 17.

The wear strip C shown in FIGS. 7 to 9 is the same as the wear strip A of FIGS. 1 to 3 except for the metal body 30 having a cross-section of substantially right-angled triangular form, and with the slots 34 extending from the face 42 adjoining the face 32 at the edge 33 a major distance through the metal body towards the face 48 between the chamfered edges 38, 40, enabling the wear strip C to be used along the edge of a scraper which works at an angle to the floor of a mixer (see FIG. 16).

In FIG. 10, a pan mixer blade 49 is shown carrying wear strips A along its lower curved edge, and wear strips B along its upright leading edge, the wear strips being secured in place by "stitch" welding W between the bodies of the wear strips and the pan mixer blade 45. The corner may be produced by milling away part of the metal body of the lowermost wear strip B over a length 50 corresponding to the depth of the adjacent end of the adjoining wear strip A. Alternatively, the corner may be provided by a corner block D as shown in FIGS. 11 to 15 in which an L-shaped metal body has bonded to it wear resistant tiles 51, 52 located in rebates 53, 54 along front and outer faces 55, 56, the edges 57 of the inner faces 58 being chamfered for ease of welding (or brazing).

In FIG. 16, a scraper 59, which is intended to work at an angle to the wall of a mixer (not shown) having a curved transition between the wall and the floor of the mixer, carries wear strips A along its straight bottom edge, and wear strips C along its upright leading edge and round the curved transition between the upright and bottom edges. A method of applying each wear strip C to the convex transition of the scraper 59 will be described presently with reference to FIGS. 23 and 24.

A sharp radius, convexly curved edge may be provided with a pre-curved wear strip E as shown in FIGS. 17 to 20 in which an arcuate metal body 60 (which may be a quarter of a metal ring) has a cross-section similar to that of the wear strip C of FIGS. 7 to 9, with wear resistant tiles 61 of trapezoidal shape bonded in pairs to one face 62 and extending from the outer edge 63 of the metal body, and with radial slots 64 extending a major distance through the metal body from the outer edge 63 to form blocks 65 of arcuate form corresponding closely to the overall form of each pair of tiles, between which radial gaps 66 open into the radial slots 64. The inner edges 67 of the arcuate metal body 60 are chamfered for ease of welding (or bazing) of the wear strip E to the curved edge portion of a scraper or plough blade (not shown).

Figure 21:
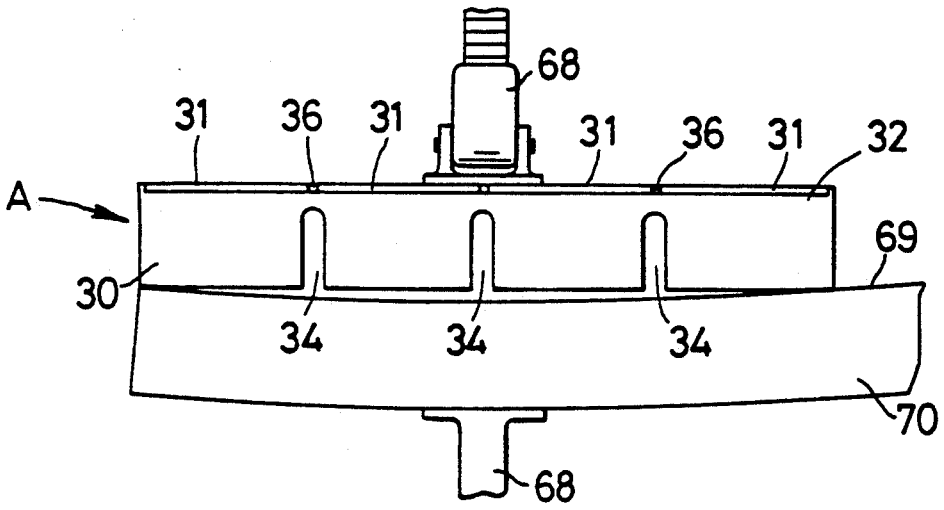
FIGS. 21 and 22 are diagrams illustrating a method of bending a wear strip A (or B) to conform to a concave face of a blade such as the blade, of FIG. 10.
Figure 22:
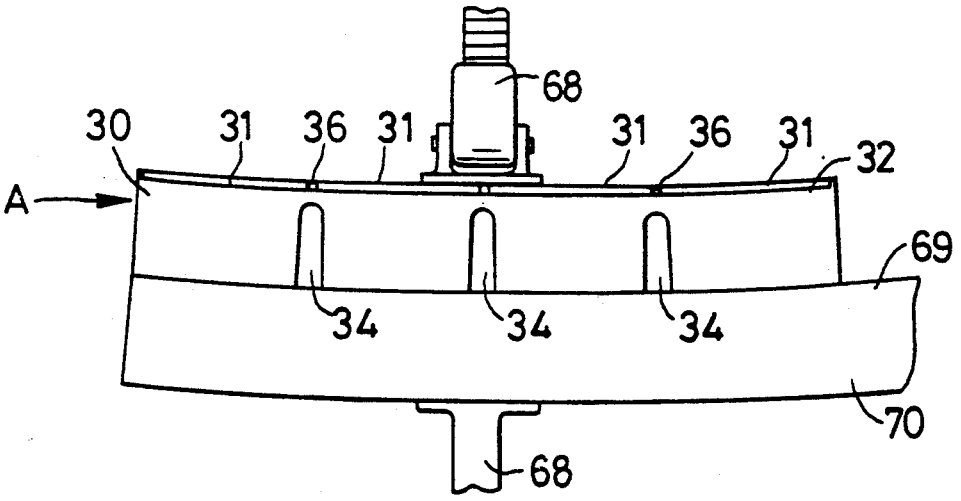

FIGS. 21 and 22 show a G-clamp 68 being used to conform a wear strip A to a concave face 69 of a blade, such as the pan mixer blade as of FIG. 10. The wear strip can then be "stitch" welded to the edge 70 as shown in FIG. 10.

Figure 23:
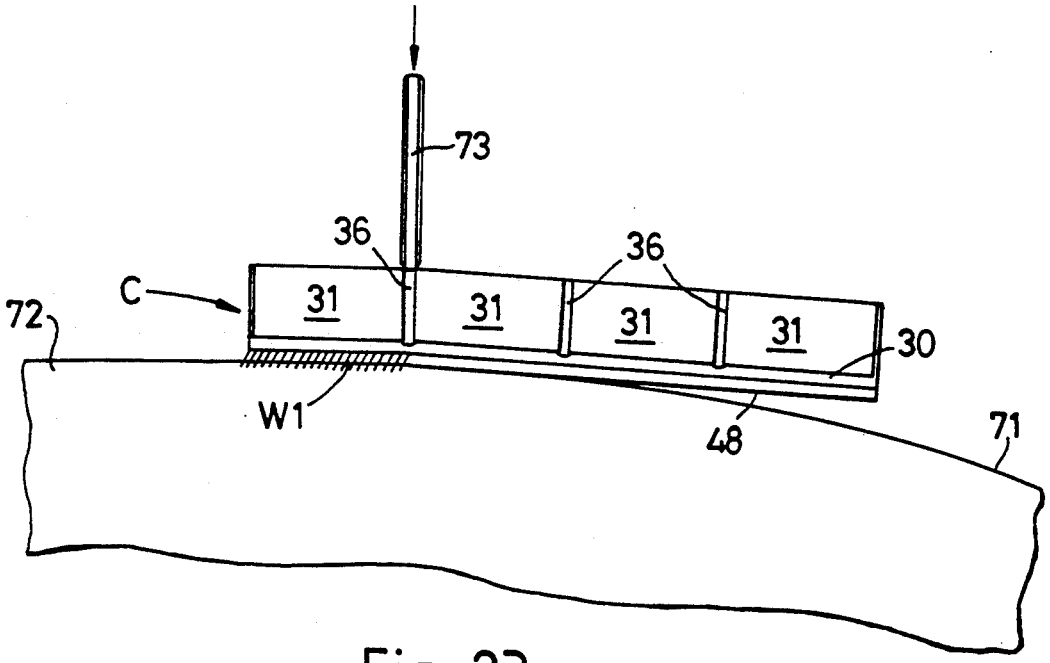
FIGS. 23 and 24 are diagrams illustrating a method of applying a wear strip C to a convex edge of a plough blade.
Figure 24:
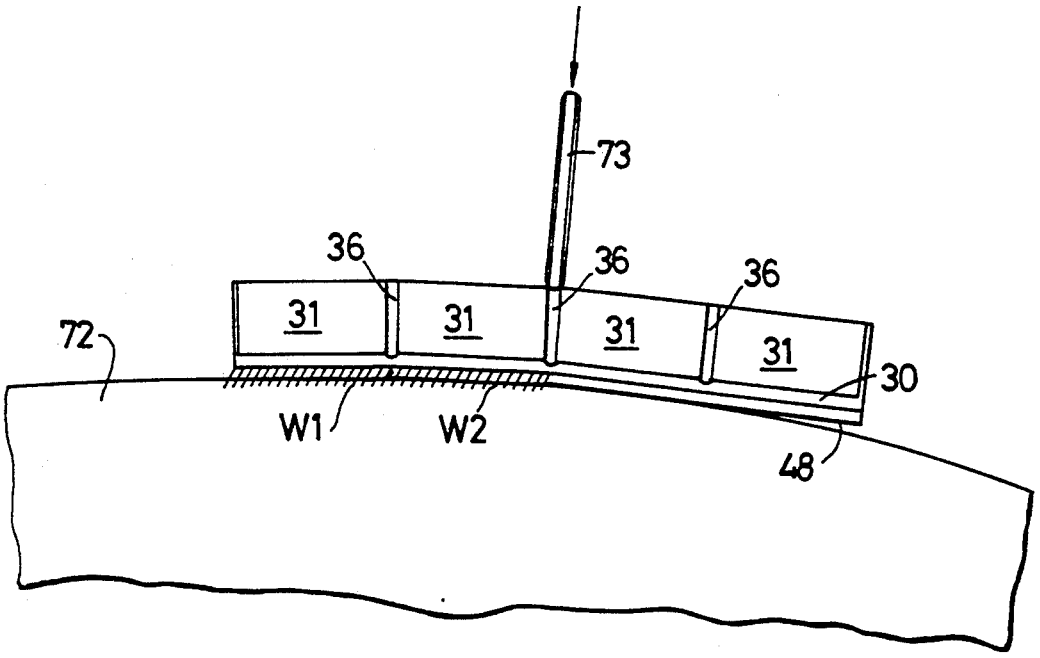

In FIG. 23 a wear strip C has been initially attached to a convex edge 71 of a plough blade 72 by a length of "stitch" welding W1 corresponding to one end tile 31, and a drift 73 is shown being driven into the gap 36 (or into the slot 34 behind) between that end tile and the adjacent tile, so as to bend the metal body 30 and bring a length of the face 48 corresponding to that adjacent tile into close proximity to the plough blade edge 71 ready for further welding W2, see FIG. 24, which also shows the drift 73 being driven into the next gap 36, so as to bend another part of the metal body 30 and bring another length of the face 48 corresponding to the next tile into close proximity to the edge 71 for still further welding (not shown), whereafter driving of the drift into the last gap 36 effects a final bending of the metal body ready for final welding to the plough blade edge over a length corresponding to the last tile 31.

I claim:

1. A wear strip comprising an elongate body of metal of substantially rectangular cross-section, and wear resistant tiles bonded to the metal body and extending across one face from at least one edge of the metal body, the tiles being spaced from each other along the metal body with gaps left between adjacent tiles, and the metal body being provided with slots extending a major distance through the metal body from the opposite face to the one carrying the tiles, with the slots in alignment with the gaps between the tiles.

2. A wear strip as in claim 1, wherein the slots are wider than the gaps.

3. A wear strip as in claim 1 or claim 2, wherein the tiles are located in a rebate, leaving the other edge of that face of the metal body available for welding.

4. A wear strip as in claim 3, wherein the end tiles are set slightly short of the ends of the body.

5. A wear strip as in, claim 1 wherein chambers are provided along two adjacent edges of the body for ease of welding.

6. A wear strip as in, claim 1 wherein further wear resistant tiles extend across an adjacent face of the metal body from the same edge as the first-mentioned wear resistant tiles, with the further tiles.

7. A wear strip as in, claim 1 wherein the metal body has a cross-section of substantially right-angled triangular form.

8. A wear strip as in, claim 1 wherein the metal body is pre-curved to suit a sharp radius, convexly curved edge of an item of equipment.

9. A wear strip as in claim 8, wherein the arcuate metal body for such a pre-curved wear strip is one quarter of a metal ring of appropriate cross-section.

10. An item of mechanical handling equipment provided with a wear strip as in claim 8 or claim 9.

11. An item of mechanical handling equipment provided with wear strips as in claim 1.

12. An item of mechanical handling equipment as in claim 10 provided with a square corner comprising a corner block in which an L-shaped metal body has bonded to its wear resistant tiles.

13. An item of mechanical handling equipment as in claim 12, wherein the wear resistant tiles are provided on only a front L-shaped face.

14. An item of mechanical handling equipment as in claim 12, wherein the wear resistant tiles are provided on both a front L-shaped face and the outer faces of the L-shaped body.

* * * * *